US006529702B2

(12) United States Patent
McStravick et al.

(10) Patent No.: US 6,529,702 B2
(45) Date of Patent: Mar. 4, 2003

(54) CLEANING BLADE ARRANGED WITH AT LEAST ONE HEATER AND PRINTER ARRANGED WITH THE SAME

(75) Inventors: Mary L. McStravick, Fairport, NY (US); Mark J. Hirsch, Fairport, NY (US); Stanley F. Smith, Jr., Concord, MA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/915,125

(22) Filed: Jul. 25, 2001

(65) Prior Publication Data

US 2003/0021617 A1 Jan. 30, 2003

(51) Int. Cl.[7] ..... G03G 21/00
(52) U.S. Cl. ..... 399/350; 399/351
(58) Field of Search ..... 399/343, 350, 399/351; 15/256.5, 256.51, 256.52

(56) References Cited

U.S. PATENT DOCUMENTS

| | | | | |
|---|---|---|---|---|
| 5,138,136 A | * | 8/1992 | Moreau et al. | 219/505 |
| 5,710,966 A | * | 1/1998 | Otsuka et al. | 399/343 |
| 5,765,075 A | * | 6/1998 | Yamamoto | 399/69 |
| 6,438,335 B1 | * | 8/2002 | Kinouchi et al. | 399/67 |

FOREIGN PATENT DOCUMENTS

| | | | |
|---|---|---|---|
| JP | 2244185 | | 9/1990 |
| JP | 05-307346 | * | 11/1993 |
| JP | 5307346 | | 11/1993 |
| JP | 06051680 | | 2/1994 |
| JP | 06-186885 | * | 7/1994 |
| JP | 07028368 | | 1/1995 |
| JP | 00075750 | | 3/2000 |

OTHER PUBLICATIONS

English translation of Yasushi Shimizu, Japanese patent document No. 06–186885, as provided Jul. 23, 2002 by Luz, Inc. Translation and Localization Solutions, 202 Potrero Avenue, San Francisco, Ca 94103, telephone 415–241–0520, http://www.luz.com, to Wayne J. Egan, Reg. 33,168, attorney of record.

* cited by examiner

*Primary Examiner*—Hoan Tran
(74) *Attorney, Agent, or Firm*—Wayne J. Egan

(57) ABSTRACT

A cleaning blade has a fixed end and a distal cleaning end, with the fixed end maintained in a substantially fixed position. The cleaning blade has a blade cleaning surface arranged for facing a photosensitive element surface of a moving photosensitive element, with the cleaning end arranged to contact and clean the photosensitive element surface. The cleaning blade has a blade temperature. The cleaning blade includes at least one heater for maintaining the blade temperature at a fixed temperature.

22 Claims, 6 Drawing Sheets

CLEANING BLADE ARRANGED WITH AT LEAST ONE HEATER AND PRINTER ARRANGED WITH THE SAME

TECHNICAL FIELD

This invention relates to cleaning blades and more particularly to a cleaning blade with at least one heater.

BACKGROUND OF THE INVENTION

Spherical toner offers many run cost and image quality improvements over conventional toner. However, the spherical particles are more difficult to clean with blade cleaning systems. Cleaning is typically easy to accomplish in warm outside environments but is much more difficult in cold conditions (Japanese C-zone). It is believed that many of the difficulties cleaning at lower temperatures are due to the cleaning blades becoming stiffer in the cold. A related problem is that of photoreceptor scratches, which are believed to be caused in the blade-photoreceptor nip. Some evidence suggests that increasing the nip pressure to improve cleaning worsens the scratch rate. It is also known that photoreceptor scratches are produced much more quickly at lower temperatures. Both photoreceptor cleaning and scratches are stressed by the cold conditions of C-zone.

DETAILED DESCRIPTION OF THE INVENTION

Briefly, a cleaning blade has a fixed end and a distal cleaning end. The cleaning blade has a blade cleaning surface arranged for facing a photosensitive element surface of a moving photosensitive element, with the cleaning end arranged to contact and clean the photosensitive element surface. The cleaning blade has a blade temperature. The cleaning blade includes temperature maintaining means comprising at least one heater for maintaining the blade temperature at a fixed temperature.

Figure 1:
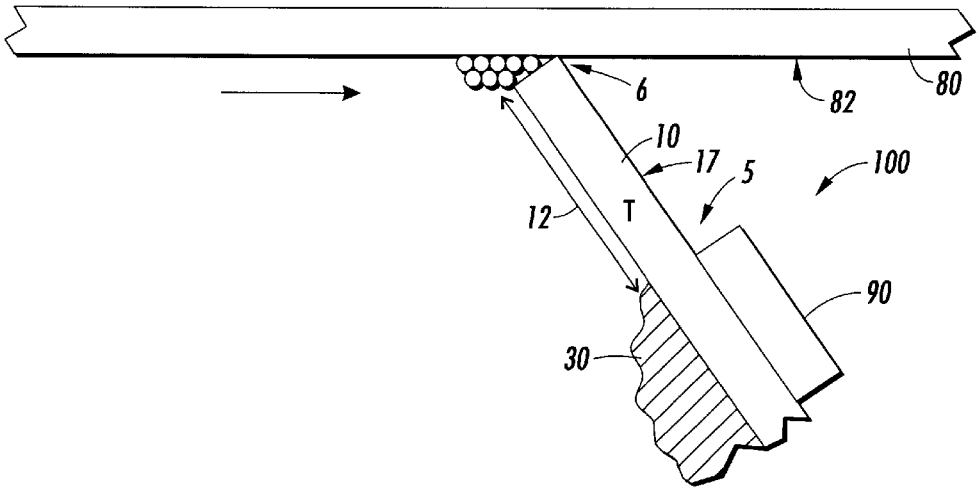
FIG. 1 depicts a cleaning blade 100 arranged with a heater 90.

Referring now to FIG. 1, there is depicted a cleaning blade 100 comprising an elongated blade portion 10 with a fixed end 5 and a distal cleaning end 6, the fixed end 5 arranged to be maintained in a substantially fixed position by a fixing or holding means generally depicted by reference number 30. As shown, the cleaning blade 100 comprises a blade cleaning surface 17 arranged for facing a photosensitive element surface 82 of a moving photosensitive element 80. The distal cleaning end 6 is arranged to contact and clean the photosensitive element surface 82. The cleaning blade 100 comprises a blade temperature, T. As discussed in greater detail below, the cleaning blade 100 includes temperature maintaining means for maintaining the blade temperature, T, at a fixed temperature.

In one embodiment, the temperature maintaining means comprises a heater depicted in FIG. 1 as element 90. As shown, the heater 90 is arranged for applying heat to the blade cleaning surface 17 at the fixed end 5. The cleaning blade distance between the heater 90 and the cleaning end 6 is depicted by the reference number 12.

Figure 2:
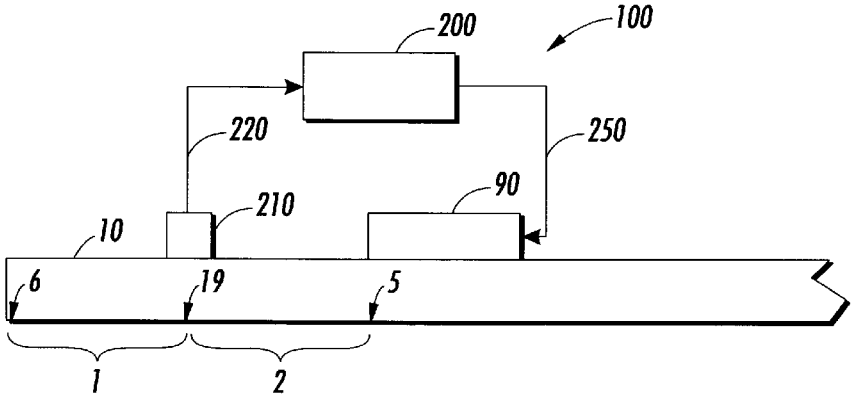
FIG. 2 depicts another embodiment of FIG. 1.

FIG. 2 depicts the FIG. 1 cleaning blade 100 arranged with a control means 200 for controlling the heater 90 based on temperature sensing means 210.

In one embodiment, the temperature sensing means 210 comprises a sensor such as, for example, a thermocouple, for sensing the blade temperature. In another embodiment, a thermometer is used.

As depicted in FIG. 2, in one embodiment, the temperature sensing means 210 is arranged for sensing the blade temperature, T, at a point 19 that is substantially equidistant between the heater 90 located at the fixed end 5 and the cleaning blade distal cleaning end 6. Thus, in this embodiment, in FIG. 2 a first distance between the distal cleaning end 6 and the temperature sensor 210 located at point 19 designated "1" is substantially equal to a second distance designated "2" between the temperature sensor 210 located at point 19 and the heater 90 located at the fixed end 5.

As shown, the temperature sensing means 210 generates a sensing output signal 220 based on the temperature, T, which sensing output signal 220 is then input to the control means 200. Responsive to this temperature-based input signal 220, in turn, the control means 200 generates a control output signal 250 that is then input to the heater 90. As a result, the control means 200 controls the heater 90 based on the temperature, T, as measured or determined by the temperature sensor 210.

In one embodiment, the control means 200 comprises a digital processor programmed to execute suitable software code.

Figure 3:
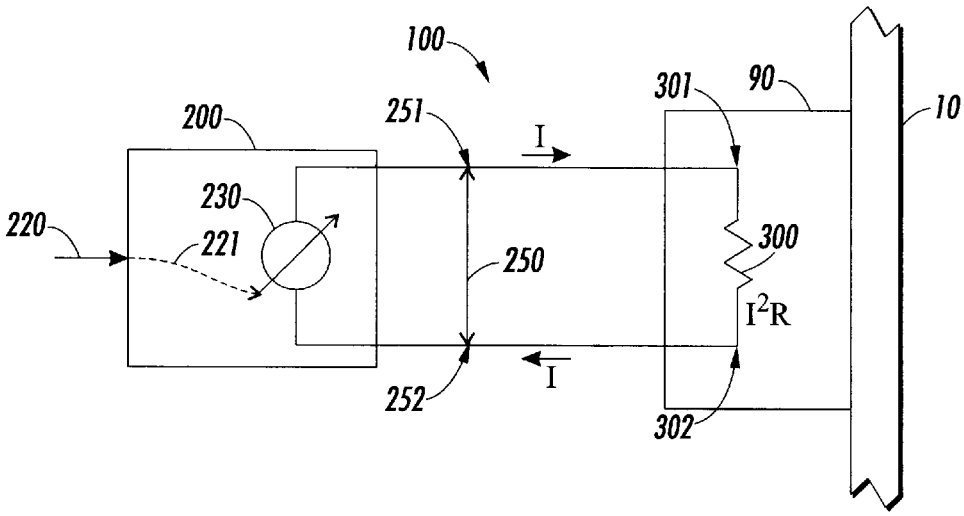
FIG. 3 depicts a further embodiment of FIG. 1.

In FIG. 3, the temperature sensing signal 220 is depicted as being presented to the control means 200 which comprises a heater signal generator 230. As shown, the input temperature sensing signal 220 is coupled 221 to the heater signal generator 230 which, in turn, is arranged to controllably generate a heater current (I), heater voltage or other heater power signal, in output signal paths 251–252. The heater power signal paths 251–252, in turn, are coupled to in the heater 90. As shown, the heater 90 couples the heater input power signals 251–252 to a heating resistance 300 by means of terminals 301–302. As known, the heater current, I, causes the heater resistance 300 to dissipate heater power based on the formula $P=I^2R$, thus resulting in the heater generating thermal heat. As a result, the control means 200 controls the dissipated heater power in the heater resistance 300 based on the blade temperature, T. Because the heater is proximate to the elongated blade portion 10, the heater generated heat therefore heats the blade portion 10 by a combination of radiation, convection and conduction. In one embodiment, the heater signal generator 230 comprises a voltage source. In another embodiment, the heater signal generator 230 comprises a current source. In another embodiment, the heater signal generator 230 comprises a power source.

Figure 4:
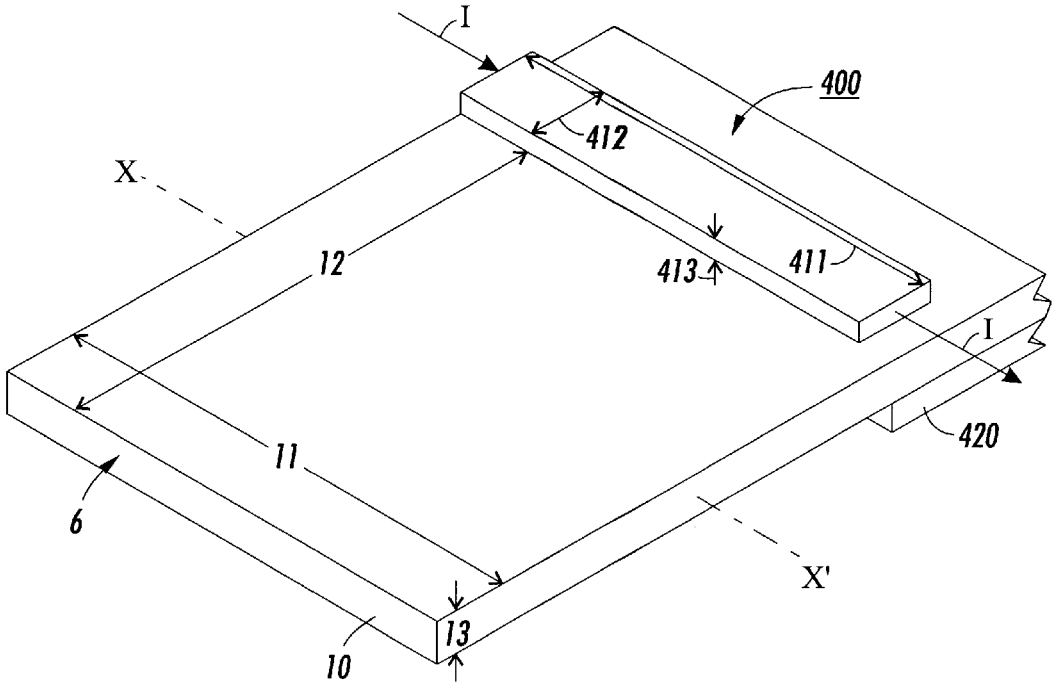
FIG. 4 depicts still another embodiment of FIG. 1.

In FIG. 4, the cleaning blade 100 comprises a heater 90 with a heater resistance fabricated by means of conductive paint or other coating 400. As shown, the resistive heating means 90 comprises a layer of conductive paint 400 disposed substantially across a width 11 of the blade cleaning surface 17.

In one embodiment, the conductive paint 400 comprises Silver Print 22-202 made by G. C. Waldom Electronics, 1801 Morgan Street, Rockford, Ill. 61102, phone number 815-968-9661. In another embodiment, the conductive paint 400 comprises a thin metallic film deposited with something like a vapor deposition technique.

Still referring to FIG. 4, in one embodiment the cleaning blade width 11 is about 305 mm, the cleaning blade thickness 13 is about 2 mm, the distance (reference number 12) from the conductive paint stripe layer 400 to the cleaning blade distal cleaning end 6 is about 8–10 mm. Also as shown, the conductive paint 400 stripe disposed across the cleaning blade width 11 has a length (reference number 411) of about 12 inches or 305 mm, a width (reference number 412) of about 4 mm, and a height or thickness (reference number 413 of about 10–50 microns. As shown, the cleaning blade 100 fixed end 5 is maintained in a substantially fixed position by a holding means or mounting bracket 420.

Figure 5:
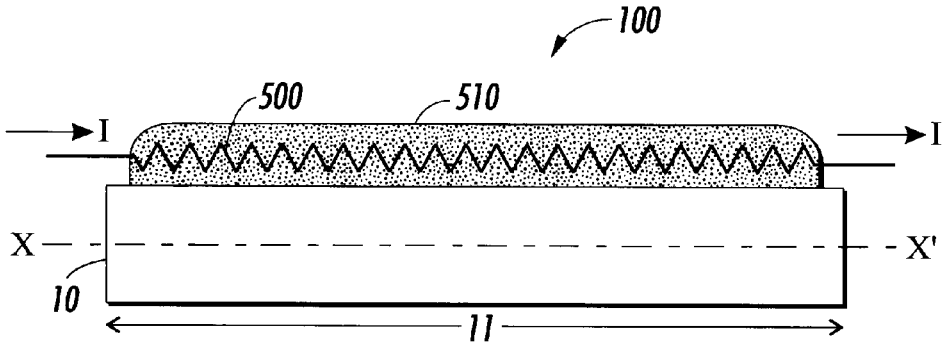
FIG. 5 depicts a still further embodiment of FIG. 1.

In FIG. 5, the cleaning blade 100 comprises a heater 90 with a heater resistance fabricated by means of resistive heating wires 500 disposed substantially across the width 11 of the blade cleaning surface 17 by means of an adhesive 510.

Referring generally to FIGS. 1–5, in one embodiment, the cleaning blade 100 is comprised of polyurethane; in one embodiment, the fixed temperature is about eighty (80) degrees Fahrenheit (F); in one embodiment, the photosensitive element 80 comprises a belt; and in another embodiment, the photosensitive element 80 comprises a drum.

Figure 6:
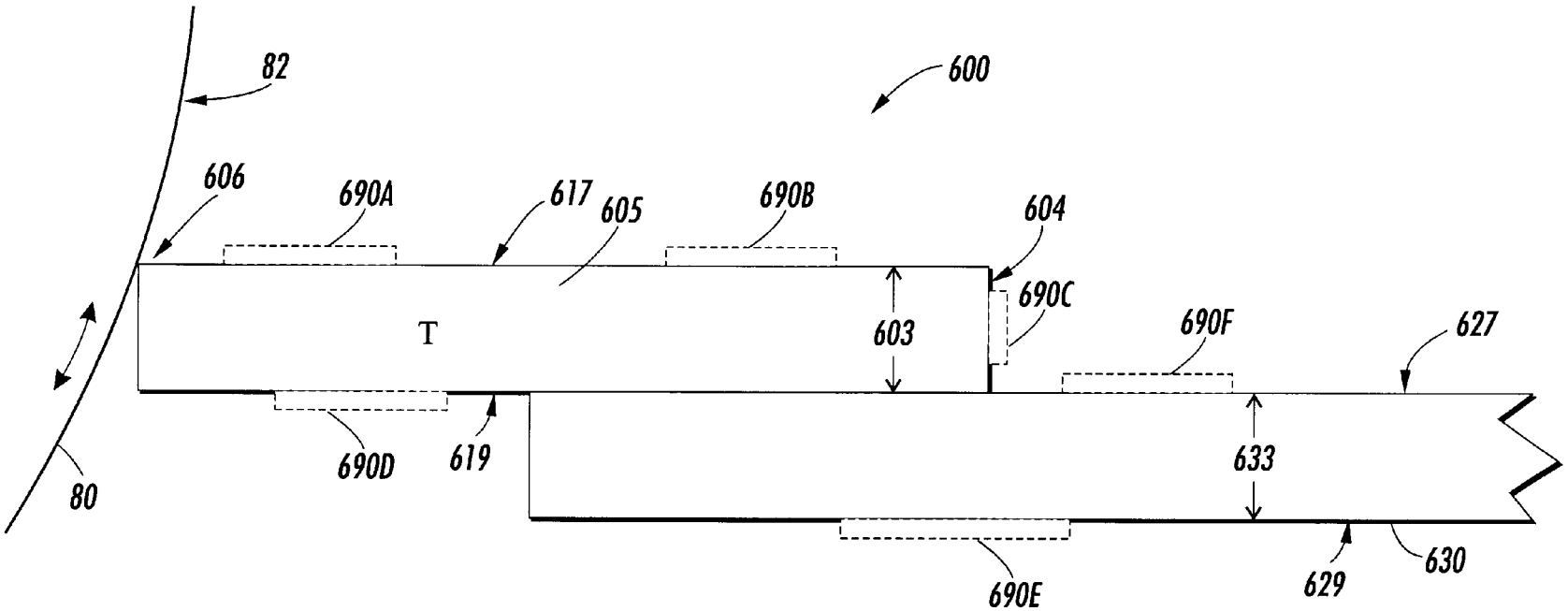
FIG. 6 depicts a first cleaning blade 600 arranged with one or more heaters.

FIG. 6 depicts a first cleaning blade 600 arranged with one or more heaters 690A–690F. Referring now to FIG. 6, there is depicted a cleaning blade 600 comprising a fixed end 605, and a distal cleaning end 606, the fixed end 605 arranged to be affixed to a holding means 630. As shown, the cleaning blade 600 further comprises a blade cleaning surface 617 arranged for facing a photosensitive element surface 82 of a moving photosensitive element 80. The cleaning blade 600 further comprises a blade back surface 619 opposite to and spaced a blade thickness 603 from the blade cleaning surface 617. As shown, the cleaning end 606 is arranged to contact and clean the photosensitive element surface 82. The cleaning blade 600 comprises a blade temperature, T. As discussed in greater detail below, the cleaning blade 600 comprises temperature maintaining means for maintaining the blade temperature at a fixed temperature.

In one embodiment, the temperature maintaining means comprises one or more heaters (depicted generally by reference numbers 690A–690F) arranged for applying heat to the cleaning blade 600. In one embodiment, the holding means 630 comprises a mounting bracket.

Still referring to FIG. 6, the holding means 630 forms a holding means mounting surface 627 arranged to be affixed to a portion of the blade back surface 619 to maintain the fixed end in a substantially fixed position. The holding means also forms a holding means back surface 629 spaced a holding means thickness 633 from the holding means mounting surface 627. Also, the cleaning blade fixed end 605 forms a cleaning blade end side surface 604 across the cleaning blade thickness 603 and substantially orthogonal to the cleaning blade cleaning surface 617.

It will be understood that the actual number of heaters 690A–690F used in any given embodiment of FIG. 6 may vary. As a result, the heaters 690A–690F are depicted in broken lines in FIG. 6.

As shown in FIG. 6, in one embodiment the heat is applied to the blade cleaning surface 617 by a first heater 690A and a second heater 690B. For example, the heat may be applied to the blade cleaning surface 617 near only its cleaning end 606 by using only the first heater 690A as shown. Or, the heat may be applied to the blade cleaning surface 617 near only its fixed end 605 by using only the second heater 690B as shown. Or, the heat may be applied to the blade cleaning surface 617 near both its cleaning end 606 and its fixed end 605 by using both the first heater 690A and the second heater 690B as shown.

In another embodiment, the heat is applied to the cleaning blade end side 604 surface by a third heater 690C as shown.

In a further embodiment, the heat is applied to the cleaning blade back surface 619 by a fourth heater 690D as shown.

In still another embodiment, the heat is applied to the holding means back surface 629 by a fifth heater 690E as shown.

In a still further embodiment, the heat is applied to the holding means mounting surface 627 by a sixth heater 690 F as shown.

Still referring to FIG. 6, in one embodiment the one or more heaters 690A–690F comprising exactly one (1) heater, that is, either 690A, 690B, 690C, 690D, 690E or 690F. In another embodiment, the one or more heaters 690A–690F comprises plural heaters, that is, at least two (2) heaters.

Referring generally to FIG. 6, in one embodiment, the cleaning blade 600 is comprised of polyurethane; in one embodiment, the fixed temperature is about eighty (80) degrees Fahrenheit (F); in one embodiment, the photosensitive element 80 comprises a belt; and in another embodiment, the photosensitive element 80 comprises a drum. Also, in one embodiment, each of the one or more heaters 690A–690F comprise the FIG. 4 conductive paint 400, the FIG. 5 resistive heating wires 500, or an equivalent.

Figure 7:
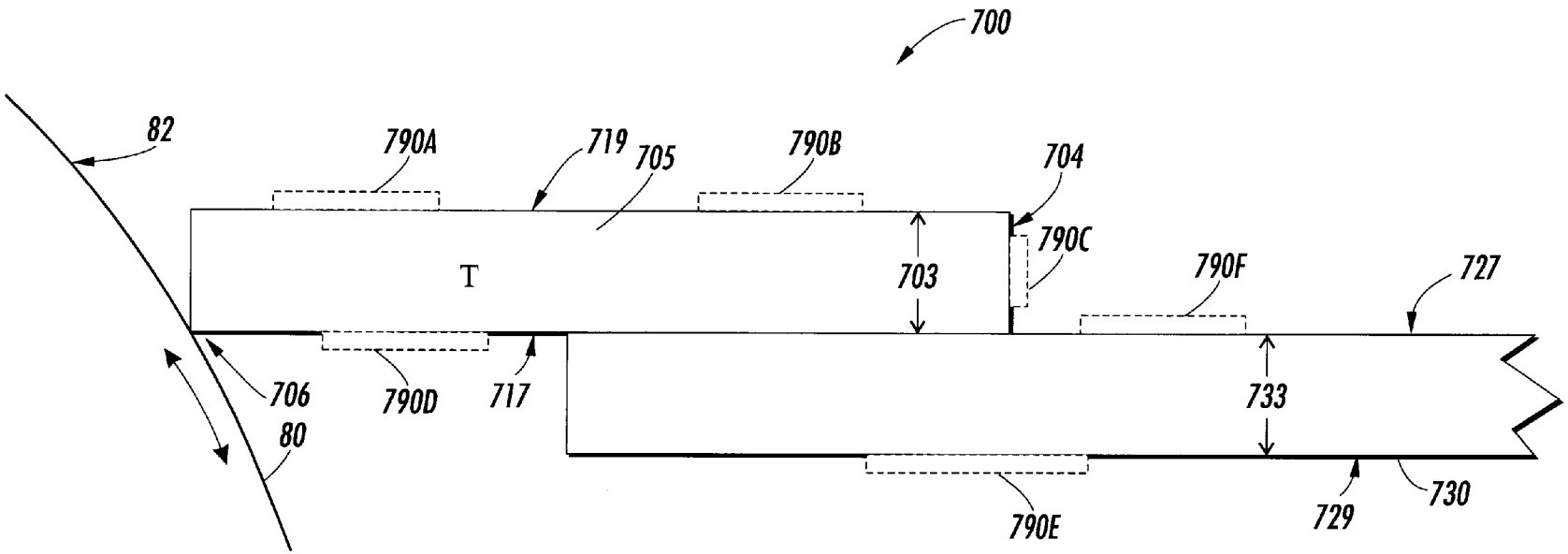
FIG. 7 depicts a second cleaning blade 700 arranged with one or more heaters.

FIG. 7 depicts a second cleaning blade 700 arranged with one or more heaters 790A–790F. Referring now to FIG. 7, there is depicted a cleaning blade 700 comprising a fixed end 705 and a distal cleaning end 706. The fixed end 705 is arranged to be affixed to a holding means 730. The cleaning blade 700 further comprises a blade cleaning surface 717 arranged for facing a photosensitive element surface 82 of a moving photosensitive element 80. The cleaning blade 700 further comprises a blade back surface 719 opposite to and spaced a blade thickness 703 from the blade cleaning surface 717. The cleaning end 706 is arranged to contact and clean the photosensitive element surface 82. The cleaning blade 700 comprises a blade temperature, T. As discussed in greater detail below, the cleaning blade 700 comprises temperature maintaining means for maintaining the blade temperature at a fixed temperature.

In one embodiment, the temperature maintaining means comprises one or more heaters 790A–790F arranged for applying heat to the cleaning blade 700.

Still referring to FIG. 7, the holding means 730 forms a holding means mounting surface 727 arranged to be affixed to a portion of the blade cleaning surface 717 to maintain the fixed end in a substantially fixed position. The fixed end 705 forms an end side surface 704 across the blade thickness 703 and substantially orthogonal to the blade cleaning surface 717. Also, the holding means 730 forms a holding means back surface 729 spaced a holding means thickness 733 from the holding means mounting surface 727.

It will be understood that the actual number of heaters 790A–790F used in any given embodiment of FIG. 7 may vary. As a result, the heaters 790A–790F are depicted in broken lines in FIG. 7.

As shown in FIG. 7, in one embodiment the heat is applied to the blade back surface 719 by a first heater 790A and a second heater 790B. For example, the heat may be applied to the blade back surface 719 near only its cleaning end 706 by using only the first heater 790A as shown. Or, the heat may be applied to the blade back surface 719 near only its fixed end 705 by using only the second heater 790B as shown. Or, the heat may be applied to 20 the blade back surface 719 near both its cleaning end 706 and its fixed end 705 by using both the first heater 790A and the second heater 790B as shown.

In another embodiment, the heat is applied to the end side surface 704 by a third heater 790C as shown.

In a further embodiment, the heat is applied to the blade cleaning surface 717 by a fourth heater 790D as shown.

In still another embodiment, the heat is applied to the holding means back surface 729 by a fifth heater 790E as shown.

In a still further embodiment, the heat is applied to the holding means mounting surface 727 by a sixth heater 790F as shown.

Still referring to FIG. 7, in one embodiment the one or more heaters 790A–790F comprising exactly one (1) heater, that is, either 790A, 790B, 790C, 790D, 790E or 790F. In another embodiment, the one or more heaters 790A–790F comprises plural heaters, that is, at least two (2) heaters.

Referring generally to FIG. 7, in one embodiment, the cleaning blade 700 is comprised of polyurethane; in one embodiment, the fixed temperature is about eighty (80) degrees Fahrenheit (F); in one embodiment, the photosensitive element 80 comprises a belt; and in another embodiment, the photosensitive element 80 comprises a drum. Also, in one embodiment, each of the one or more heaters 790A–790F comprise the FIG. 4 conductive paint 400, the FIG. 5 resistive heating wires 500, or an equivalent.

Referring generally to FIGS. 1–7, in one embodiment, the FIGS. 1–5 cleaning blade 100, the FIG. 6 cleaning blade 600, and the FIG. 7 cleaning blade 700 are manufactured by Hokushin in Japan, and the ID number of the urethane is 238707. In another embodiment, the aforementioned cleaning blades 100, 600 and 700 comprise urethane blade number 107-5 made by Acushnet Rubber Company, 744 Belleville Avenue, New Bedford, Mass. 02745, phone number 508-998-4000, website www.acushnet.com.

Therefore, referring generally to FIGS. 1–7, in accordance with the present invention, a cleaning blade (100, 600, 700)—as discussed below, whether or not xerographic—comprises a fixed end (5, 605, 705) and a distal cleaning end (6, 606, 706), the cleaning blade comprising a blade cleaning surface (17, 617, 717), the cleaning blade comprising a blade temperature, T, the cleaning blade including temperature maintaining means for maintaining the blade temperature at a fixed temperature. In one embodiment, the temperature maintaining means comprises one or more heaters (90, 690A–690F, 790A–790F), arranged for applying heat to the cleaning blade. Moreover, it is believed the present invention is generally applicable to all cleaning blades, whether or not the cleaning blades themselves are used in a xerographic application. In one embodiment, the cleaning blade surface is arranged for facing a photosensitive element surface (82) of a moving photosensitive element (80), the cleaning end arranged to contact and clean the photosensitive element surface. In one embodiment, the photosensitive element comprises a belt. In another embodiment, the photosensitive element comprises a drum.

Figure 8:
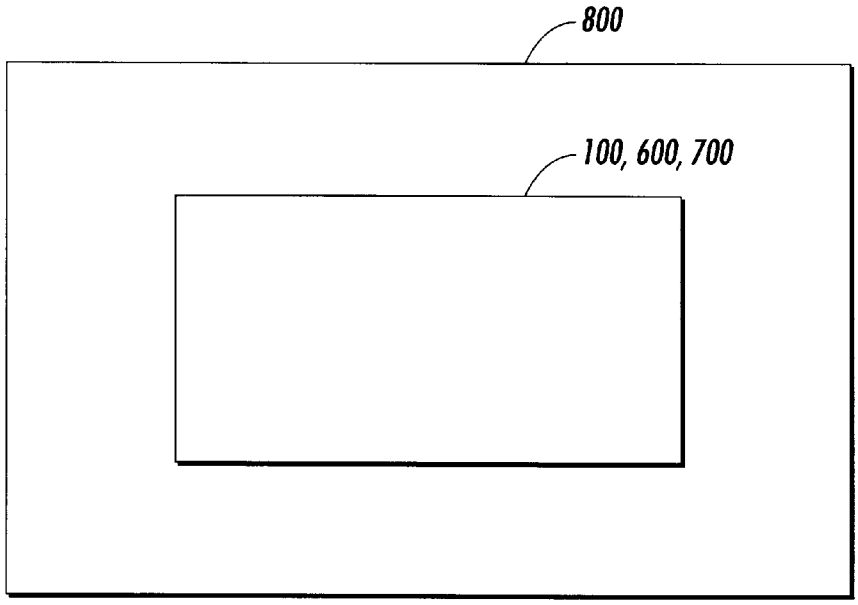
FIG. 8 depicts a printing machine 800 comprising the FIG. 1 cleaning blade 100, the FIG. 6 cleaning blade 600, or the FIG. 7 cleaning blade 700.

FIG. 8 depicts a printing machine 800 comprising a cleaning blade 100, 600 or 700 arranged with at least one heater. Referring now to FIG. 8, there is depicted a printing machine 800 comprising a cleaning blade 100 as discussed above in connection with FIGS. 1–5, or cleaning blade 600 as discussed above in connection with FIG. 6, or cleaning blade 700 as discussed above in connection with FIG. 7.

Thus, a resistive heater is used on the blade to maintain its temperature when the outside environment gets colder. The heater is controlled by controlling the resistive heater current. In turn, the resistive heater current determines the temperature rise of the blade over the temperature of its surroundings. In one embodiment, the control system for the resistive heater current comprises a thermometer and a lookup table to determine the proper current. In another embodiment, the control system for the resistive heater current comprises a thermocouple mounted in, on, or near the blade whose output is fed back to a controller that maintains the proper blade temperature. Maintaining the blade at a warm temperature improves both photoreceptor cleaning of spherical toner and the photoreceptor scratch defect. If sufficient latitude for photoreceptor cleaning is achieved, the blade pressure could be reduced to further improve the scratch defect.

While this technology is useful to xerographic systems using spherical toner, it is not limited to such applications. On the contrary, this technology is believed widely and generally applicable to all blade cleaners, including non-xerographic uses thereof.

While various embodiments of a cleaning blade arranged with at least one heater and printer arranged with the same have been disclosed hereinabove, the scope of the invention is defined by the following claims.

What is claimed is:

1. A cleaning blade comprising a fixed end and a distal cleaning end, the cleaning blade comprising a blade cleaning surface arranged for facing a photosensitive element surface of a moving photosensitive element, the cleaning end arranged to contact and clean the photosensitive element surface, the cleaning blade comprising a blade temperature, the cleaning blade including a heater for maintaining the blade temperature at a fixed temperature, the heater disposed on the blade cleaning surface at the fixed end, including sensing means for sensing the blade temperature, the sensing means comprising a thermocouple disposed on the blade cleaning surface at a point substantially equidistant between the heater and the cleaning end for sensing the blade temperature, including control means for controlling the heater based on the blade temperature that is sensed by the thermocouple, the heater comprising resistive heating means, the resistive heating means comprising a layer of conductive paint disposed substantially across a width of the blade cleaning surface.

2. A cleaning blade comprising a fixed end and a distal cleaning end, the cleaning blade comprising a blade cleaning surface arranged for facing a photosensitive element surface of a moving photosensitive element, the cleaning end arranged to contact and clean the photosensitive element surface, the cleaning blade comprising a blade temperature, the cleaning blade including a heater for maintaining the blade temperature at a fixed temperature, the heater disposed on the blade cleaning surface at the fixed end, including sensing means for sensing the blade temperature, the sensing means comprising a thermocouple disposed on the blade cleaning surface at a point substantially equidistant between the heater and the cleaning end for sensing the blade temperature, including control means for controlling the heater based on the blade temperature that is sensed by the thermocouple, the heater comprising resistive heating means, the resistive heating means comprising resistive heating wires disposed substantially across a width of the blade cleaning surface by means of an adhesive.

3. A cleaning blade comprising a fixed end and a distal cleaning end, the fixed end arranged to be affixed to a holding means, the cleaning blade further comprising a blade cleaning surface arranged for facing a photosensitive element surface of a moving photosensitive element, a blade back surface opposite to and spaced a blade thickness from the blade cleaning surface, the cleaning end arranged to contact and clean the photosensitive element surface, the cleaning blade comprising a blade temperature, the cleaning blade comprising one or more heaters for applying heat to the cleaning blade to thereby maintain the blade temperature at a fixed temperature, the fixed end forming an end side surface across the blade thickness and substantially orthogonal to the blade cleaning surface, the one or more heaters including at least one heater disposed on the end side surface, the cleaning blade being comprised of polyurethane, the fixed temperature being about eighty degrees Fahrenheit, the at least one heater disposed on the end side surface comprising a layer of conductive paint.

4. A cleaning blade comprising a fixed end and a distal cleaning end, the fixed end arranged to be affixed to a holding means, the cleaning blade further comprising a blade cleaning surface arranged for facing a photosensitive element surface of a moving photosensitive element, a blade back surface opposite to and spaced a blade thickness from the blade cleaning surface, the cleaning end arranged to contact and clean the photosensitive element surface, the cleaning blade comprising a blade temperature, the cleaning blade comprising one or more heaters for applying heat to the cleaning blade to thereby maintain the blade temperature at a fixed temperature, the fixed end forming an end side surface across the blade thickness and substantially orthogonal to the blade cleaning surface, the one or more heaters including at least one heater disposed on the end side surface, the cleaning blade being comprised of polyurethane, the fixed temperature being about eighty degrees Fahrenheit, the at least one heater disposed on the end side surface comprising resistive heating wires disposed thereon by means of an adhesive.

5. A cleaning blade comprising a fixed end and a distal cleaning end, the fixed end arranged to be affixed to a holding means, the cleaning blade further comprising a blade cleaning surface arranged for facing a photosensitive element surface of a moving photosensitive element, a blade back surface opposite to and spaced a blade thickness from the blade cleaning surface, the cleaning end arranged to contact and clean the photosensitive element surface, the cleaning blade comprising a blade temperature, the cleaning blade comprising one or more heaters for applying heat to the cleaning blade to thereby maintain the blade temperature at a fixed temperature, the holding means forming a holding means mounting surface arranged to be affixed to a portion of the blade back surface to maintain the fixed end in a substantially fixed position, the one or more heaters including at least one heater disposed on the blade cleaning surface near the cleaning end, the cleaning blade being comprised of polyurethane, the fixed temperature being about eighty degrees Fahrenheit, the at least one heater disposed on the blade cleaning surface comprising a layer of conductive paint.

6. A cleaning blade comprising a fixed end and a distal cleaning end, the fixed end arranged to be affixed to a holding means, the cleaning blade further comprising a blade cleaning surface arranged for facing a photosensitive element surface of a moving photosensitive element, a blade back surface opposite to and spaced a blade thickness from the blade cleaning surface, the cleaning end arranged to contact and clean the photosensitive element surface, the cleaning blade comprising a blade temperature, the cleaning blade comprising one or more heaters for applying heat to the cleaning blade to thereby maintain the blade temperature at a fixed temperature, the holding means forming a holding means mounting surface arranged to be affixed to a portion of the blade back surface to maintain the fixed end in a substantially fixed position, the one or more heaters including at least one heater disposed on the blade cleaning surface near the cleaning end, the cleaning blade being comprised of polyurethane, the fixed temperature being about eighty degrees Fahrenheit, the at least one heater disposed on the blade cleaning surface comprising resistive heating wires disposed thereon by means of an adhesive.

7. A cleaning blade comprising a fixed end and a distal cleaning end, the fixed end arranged to be affixed to a holding means, the cleaning blade further comprising a blade cleaning surface arranged for facing a photosensitive element surface of a moving photosensitive element, a blade back surface opposite to and spaced a blade thickness from the blade cleaning surface, the cleaning end arranged to contact and clean the photosensitive element surface, the cleaning blade comprising a blade temperature, the cleaning blade comprising one or more heaters for applying heat to the cleaning blade to thereby maintain the blade temperature at a fixed temperature, the holding means forming a holding means mounting surface arranged to be affixed to a portion of the blade back surface to maintain the fixed end in a substantially fixed position, the holding means also forming a holding means back surface spaced a holding means thickness from the holding means mounting surface, the one or more heaters including at least one heater disposed on the holding means back surface, the cleaning blade being comprised of polyurethane, the fixed temperature being about eighty degrees Fahrenheit, the at least one heater disposed on the holding means back surface comprising a layer of conductive paint.

8. A cleaning blade comprising a fixed end and a distal cleaning end, the fixed end arranged to be affixed to a holding means, the cleaning blade further comprising a blade cleaning surface arranged for facing a photosensitive element surface of a moving photosensitive element, a blade back surface opposite to and spaced a blade thickness from the blade cleaning surface, the cleaning end arranged to contact and clean the photosensitive element surface, the cleaning blade comprising a blade temperature, the cleaning blade comprising one or more heaters for applying heat to the cleaning blade to thereby maintain the blade temperature at a fixed temperature, the holding means forming a holding means mounting surface arranged to be affixed to a portion of the blade back surface to maintain the fixed end in a substantially fixed position, the holding means also forming a holding means back surface spaced a holding means thickness from the holding means mounting surface, the one or more heaters including at least one heater disposed on the holding means back surface, the cleaning blade being comprised of polyurethane, the fixed temperature being about eighty degrees Fahrenheit, the at least one heater disposed on the holding means back surface comprising resistive heating wires disposed thereon by means of an adhesive.

9. A cleaning blade comprising a fixed end and a distal cleaning end, the fixed end arranged to be affixed to a holding means, the cleaning blade further comprising a blade cleaning surface arranged for facing a photosensitive element surface of a moving photosensitive element, a blade back surface opposite to and spaced a blade thickness from the blade cleaning surface, the cleaning end arranged to contact and clean the photosensitive element surface, the cleaning blade comprising a blade temperature, the cleaning blade comprising one or more heaters for applying heat to the cleaning blade to thereby maintain the blade temperature at a fixed temperature, the holding means forming a holding means mounting surface arranged to be affixed to a portion of the blade cleaning surface to maintain the fixed end in a substantially fixed position, the one or more heaters including at least one heater disposed on the blade back surface, the at least one heater disposed on the blade back surface near the cleaning end, the cleaning blade being comprised of polyurethane, the fixed temperature being about eighty degrees Fahrenheit, the at least one heater disposed on the blade back surface comprising a layer of conductive paint.

10. A cleaning blade comprising a fixed end and a distal cleaning end, the fixed end arranged to be affixed to a holding means, the cleaning blade further comprising a blade cleaning surface arranged for facing a photosensitive element surface of a moving photosensitive element, a blade back surface opposite to and spaced a blade thickness from the blade cleaning surface, the cleaning end arranged to contact and clean the photosensitive element surface, the cleaning blade comprising a blade temperature, the cleaning blade comprising one or more heaters for applying heat to the cleaning blade to thereby maintain the blade temperature at a fixed temperature, the holding means forming a holding means mounting surface arranged to be affixed to a portion of the blade cleaning surface to maintain the fixed end in a substantially fixed position, the one or more heaters including at least one heater disposed on the blade back surface, the at least one heater disposed on the blade back surface near the cleaning end, the cleaning blade being comprised of polyurethane, the fixed temperature being about eighty degrees Fahrenheit, the at least one heater disposed on the blade back surface comprising resistive heating wires disposed thereon by means of an adhesive.

11. A cleaning blade comprising a fixed end and a distal cleaning end, the fixed end arranged to be affixed to a holding means, the cleaning blade further comprising a blade cleaning surface arranged for facing a photosensitive element surface of a moving photosensitive element, a blade back surface opposite to and spaced a blade thickness from the blade cleaning surface, the cleaning end arranged to contact and clean the photosensitive element surface, the cleaning blade comprising a blade temperature, the cleaning blade comprising one or more heaters for applying heat to the cleaning blade to thereby maintain the blade temperature at a fixed temperature, the holding means forming a holding means mounting surface arranged to be affixed to a portion of the blade cleaning surface to maintain the fixed end in a substantially fixed position, the one or more heaters including at least one heater disposed on the blade back surface, the at least one heater disposed on the blade back surface near the fixed end, the cleaning blade being comprised of polyurethane, the fixed temperature being about eighty degrees Fahrenheit, the at least one heater disposed on the blade back surface comprising a layer of conductive paint.

12. A cleaning blade comprising a fixed end and a distal cleaning end, the fixed end arranged to be affixed to a holding means, the cleaning blade further comprising a blade cleaning surface arranged for facing a photosensitive element surface of a moving photosensitive element, a blade back surface opposite to and spaced a blade thickness from the blade cleaning surface, the cleaning end arranged to contact and clean the photosensitive element surface, the cleaning blade comprising a blade temperature, the cleaning blade comprising one or more heaters for applying heat to the cleaning blade to thereby maintain the blade temperature at a fixed temperature, the holding means forming a holding means mounting surface arranged to be affixed to a portion of the blade cleaning surface to maintain the fixed end in a substantially fixed position, the one or more heaters including at least one heater disposed on the blade back surface, the at least one heater disposed on the blade back surface near the fixed end, the cleaning blade being comprised of polyurethane, the fixed temperature being about eighty degrees Fahrenheit, the at least one heater disposed on the blade back surface comprising resistive heating wires disposed thereon by means of an adhesive.

13. A cleaning blade comprising a fixed end and a distal cleaning end, the fixed end arranged to be affixed to a holding means, the cleaning blade further comprising a blade cleaning surface arranged for facing a photosensitive element surface of a moving photosensitive element, a blade back surface opposite to and spaced a blade thickness from the blade cleaning surface, the cleaning end arranged to contact and clean the photosensitive element surface, the cleaning blade comprising a blade temperature, the cleaning blade comprising one or more heaters for applying heat to the cleaning blade to thereby maintain the blade temperature at a fixed temperature, the holding means forming a holding means mounting surface arranged to be affixed to a portion of the blade cleaning surface to maintain the fixed end in a substantially fixed position, the one or more heaters including at least one heater disposed on the blade cleaning surface, the cleaning blade being comprised of polyurethane, the fixed temperature being about eighty degrees Fahrenheit, the at least one heater disposed on the blade cleaning surface comprising a layer of conductive paint.

14. A cleaning blade comprising a fixed end and a distal cleaning end, the fixed end arranged to be affixed to a holding means, the cleaning blade further comprising a blade cleaning surface arranged for facing a photosensitive element surface of a moving photosensitive element, a blade back surface opposite to and spaced a blade thickness from the blade cleaning surface, the cleaning end arranged to contact and clean the photosensitive element surface, the cleaning blade comprising a blade temperature, the cleaning blade comprising one or more heaters for applying heat to the cleaning blade to thereby maintain the blade temperature at a fixed temperature, the holding means forming a holding means mounting surface arranged to be affixed to a portion of the blade cleaning surface to maintain the fixed end in a substantially fixed position, the one or more heaters including at least one heater disposed on the blade cleaning surface, the cleaning blade being comprised of polyurethane, the fixed temperature being about eighty degrees Fahrenheit, the at least one heater disposed on the blade cleaning surface comprising resistive heating wires disposed thereon by means of an adhesive.

15. A cleaning blade comprising a fixed end and a distal cleaning end, the fixed end arranged to be affixed to a holding means, the cleaning blade further comprising a blade cleaning surface arranged for facing a photosensitive element surface of a moving photosensitive element, a blade back surface opposite to and spaced a blade thickness from the blade cleaning surface, the cleaning end arranged to contact and clean the photosensitive element surface, the cleaning blade comprising a blade temperature, the cleaning blade comprising one or more heaters for applying heat to the cleaning blade to thereby maintain the blade temperature at a fixed temperature, the holding means forming a holding means mounting surface arranged to be affixed to a portion of the blade cleaning surface to maintain the fixed end in a substantially fixed position, the holding means also forming a holding means back surface spaced a holding means thickness from the holding means mounting surface, the one or more heaters including at least one heater disposed on the holding means back surface, the cleaning blade being comprised of polyurethane, the fixed temperature being about eighty degrees Fahrenheit, the at least one heater disposed on the holding means back surface comprising a layer of conductive paint.

16. A cleaning blade comprising a fixed end and a distal cleaning end, the fixed end arranged to be affixed to a holding means, the cleaning blade further comprising a blade cleaning surface arranged for facing a photosensitive element surface of a moving photosensitive element, a blade back surface opposite to and spaced a blade thickness from the blade cleaning surface, the cleaning end arranged to contact and clean the photosensitive element surface, the cleaning blade comprising a blade temperature, the cleaning blade comprising one or more heaters for applying heat to the cleaning blade to thereby maintain the blade temperature at a fixed temperature, the holding means forming a holding means mounting surface arranged to be affixed to a portion of the blade cleaning surface to maintain the fixed end in a substantially fixed position, the holding means also forming a holding means back surface spaced a holding means thickness from the holding means mounting surface, the one or more heaters including at least one heater disposed on the holding means back surface, the cleaning blade being comprised of polyurethane, the fixed temperature being about eighty degrees Fahrenheit, the at least one heater disposed on the holding means back surface comprising resistive heating wires disposed thereon by means of an adhesive.

17. A cleaning blade comprising a fixed end and a distal cleaning end, the fixed end arranged to be affixed to a holding means, the cleaning blade further comprising a blade cleaning surface arranged for facing a photosensitive element surface of a moving photosensitive element, a blade back surface opposite to and spaced a blade thickness from the blade cleaning surface, the cleaning end arranged to contact and clean the photosensitive element surface, the cleaning blade comprising a blade temperature, the cleaning blade comprising one or more heaters for applying heat to the cleaning blade to thereby maintain the blade temperature at a fixed temperature, the holding means forming a holding means mounting surface arranged to be affixed to a portion of the blade cleaning surface to maintain the fixed end in a substantially fixed position, the one or more heaters including at least one heater disposed on the holding means mounting surface, the cleaning blade being comprised of polyurethane, the fixed temperature being about eighty degrees Fahrenheit, the at least one heater disposed on the holding means mounting surface comprising a layer of conductive paint.

18. A cleaning blade comprising a fixed end and a distal cleaning end, the fixed end arranged to be affixed to a holding means, the cleaning blade further comprising a blade cleaning surface arranged for facing a photosensitive element surface of a moving photosensitive element, a blade back surface opposite to and spaced a blade thickness from the blade cleaning surface, the cleaning end arranged to contact and clean the photosensitive element surface, the cleaning blade comprising a blade temperature, the cleaning blade comprising one or more heaters for applying heat to the cleaning blade to thereby maintain the blade temperature at a fixed temperature, the holding means forming a holding means mounting surface arranged to be affixed to a portion of the blade cleaning surface to maintain the fixed end in a substantially fixed position, the one or more heaters including at least one heater disposed on the holding means mounting surface, the cleaning blade being comprised of polyurethane, the fixed temperature being about eighty degrees Fahrenheit, the at least one heater disposed on the holding means mounting surface comprising resistive heating wires disposed thereon by means of an adhesive.

19. A cleaning blade comprising a fixed end and a distal cleaning end, the cleaning blade comprising a blade cleaning surface, the cleaning blade comprising a blade temperature, the cleaning blade including a heating means, a temperature sensing means and a control means for controlling the heating means based on the temperature sensing means, the heating means comprising one or more heaters disposed on the cleaning blade, the blade cleaning surface arranged for facing a photosensitive element surface of a moving photosensitive element, the cleaning end arranged to contact and clean the photosensitive element surface, the one or more heaters disposed on the cleaning blade being disposed on the blade cleaning surface, the cleaning blade being comprised of polyurethane, the fixed temperature being about eighty degrees Fahrenheit, the one or more heaters disposed on the blade cleaning surface comprising at least one layer of conductive paint.

20. A cleaning blade comprising a fixed end and a distal cleaning end, the cleaning blade comprising a blade cleaning surface, the cleaning blade comprising a blade temperature, the cleaning blade including a heating means, a temperature sensing means and a control means for controlling the heating means based on the temperature sensing means, the heating means comprising one or more heaters disposed on the cleaning blade, the blade cleaning surface arranged for facing a photosensitive element surface of a moving photosensitive element, the cleaning end arranged to contact and clean the photosensitive element surface, the one or more heaters disposed on the cleaning blade being disposed on the blade cleaning surface, the cleaning blade being comprised of polyurethane, the fixed temperature being about eighty degrees Fahrenheit, the one or more heaters disposed on the blade cleaning surface comprising resistive heating wires disposed thereon by means of an adhesive.

21. A printing machine comprising a cleaning blade, the cleaning blade comprising a fixed end and a distal cleaning end, the blade fixed end maintained in a substantially fixed position, the cleaning blade comprising a blade cleaning surface arranged for facing a photosensitive element surface of a moving photosensitive element, the cleaning end arranged to contact and clean the photosensitive element surface, the cleaning blade comprising a blade temperature, the cleaning blade including a heating means, a temperature sensing means and a control means for controlling the heating means based on the temperature sensing means, the heating means comprising one or more heaters disposed on the cleaning blade, the one or more heaters disposed on the cleaning blade being disposed on the blade cleaning surface, the cleaning blade being comprised of polyurethane, the fixed temperature being about eighty degrees Fahrenheit, the one or more heaters disposed on the blade cleaning surface comprising at least one layer of conductive paint.

22. A printing machine comprising a cleaning blade, the cleaning blade comprising a fixed end and a distal cleaning end, the blade fixed end maintained in a substantially fixed position, the cleaning blade comprising a blade cleaning surface arranged for facing a photosensitive element surface of a moving photosensitive element, the cleaning end arranged to contact and clean the photosensitive element surface, the cleaning blade comprising a blade temperature, the cleaning blade including a heating means, a temperature sensing means and a control means for controlling the heating means based on the temperature sensing means, the heating means comprising one or more heaters disposed on the cleaning blade, the one or more heaters disposed on the cleaning blade being disposed on the blade cleaning surface, the cleaning blade being comprised of polyurethane, the fixed temperature being about eighty degrees Fahrenheit, the one or more heaters disposed on the blade cleaning surface comprising resistive heating wires disposed thereon by means of an adhesive.

* * * * *